US006884138B1

(12) United States Patent
Ando et al.

(10) Patent No.: US 6,884,138 B1
(45) Date of Patent: Apr. 26, 2005

(54) METHOD FOR MANUFACTURING SPACER FOR ELECTRON SOURCE APPARATUS, SPACER, AND ELECTRON SOURCE APPARATUS USING SPACER

(75) Inventors: Yoichi Ando, Inagi (JP); Masahiro Fushimi, Zama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/511,349

(22) Filed: Feb. 23, 2000

(30) Foreign Application Priority Data

Feb. 25, 1999 (JP) ..... 11-048889
Feb. 18, 2000 (JP) ..... 2000-041255

(51) Int. Cl.[7] ..... H01J 9/00
(52) U.S. Cl. ..... 445/24; 445/25
(58) Field of Search ..... 445/24, 25; 313/238, 313/292, 495, 496, 497; 427/66, 68, 77

(56) References Cited

U.S. PATENT DOCUMENTS

| | | | | | |
|---|---|---|---|---|---|
| 3,658,568 | A | * | 4/1972 | Donley | 427/165 |
| 4,769,575 | A | | 9/1988 | Murata et al. | 313/495 |
| 4,904,895 | A | | 2/1990 | Tsukamoto et al. | 313/336 |
| 5,066,883 | A | | 11/1991 | Yoshioka et al. | 313/309 |
| 5,561,343 | A | * | 10/1996 | Lowe | 445/24 |
| 5,682,085 | A | | 10/1997 | Suzuki et al. | 315/169.1 |
| 5,717,287 | A | * | 2/1998 | Amrine et al. | 445/24 |
| 5,760,538 | A | | 6/1998 | Mitsutake et al. | 313/422 |
| 5,811,927 | A | * | 9/1998 | Anderson et al. | 445/24 |
| 6,053,791 | A | | 4/2000 | Fujii et al. | 445/6 |
| 6,068,532 | A | * | 5/2000 | Lai et al. | 445/24 |
| 6,262,528 | B1 | * | 7/2001 | Kim | 445/24 |
| 6,517,399 | B1 | * | 2/2003 | Ito et al. | 445/24 |

FOREIGN PATENT DOCUMENTS

| | | | |
|---|---|---|---|
| EP | 0 394 698 | 10/1990 | |
| JP | 57-118355 | 7/1982 | |
| JP | 61-124031 | 6/1986 | |
| JP | 64-31332 | 2/1989 | |
| JP | 2-257551 | 10/1990 | |
| JP | 3-55738 | 3/1991 | |
| JP | 4-28137 | 1/1992 | |
| JP | 8-180821 | 7/1996 | |
| WO | WO 9418694 A1 * | 8/1994 | ..... H01J/63/02 |

OTHER PUBLICATIONS

J. Dyke et al., "Field Emission", Advances in Electronics and Electron Physics, vol. VIII, 1956, pp. 89–185.

M.I. Elinson et al., "The Emission of Hot Electrons and The Field Emission of Electrons From Tin Oxide", Radio Engineering and Electronic Physics, Jul. 1965, pp. 1290–1296.

H. Araki, "Electroforming and Electron Emission of Carbon Thin Films", Journal of th Vacuum, Society of Japan, 1983, pp. 22–29 (with English Abstract on p. 22).

G. Dittmer, "Electrical Conduction and Electron Emission of Discontinuous Thin Films", Thin Solid Films, 9, 1972, pp. 317–328.

(Continued)

*Primary Examiner*—Nimeshkumar D. Patel
*Assistant Examiner*—Mariceli Santiago
(74) *Attorney, Agent, or Firm*—Fitzpatrick, Cella, Harper & Scinto

(57) ABSTRACT

A method for manufacturing a spacer for use in an electron source apparatus comprising an electron source having an electron emission device, an opposing member opposed to the electron source and a spacer provided between the electron ray source and the opposing member, the method comprising a coating step for providing a film on a spacer substrate constituting the spacer, the coating step including a step for bringing a preformed film type material into contact with the spacer substrate.

19 Claims, 9 Drawing Sheets

OTHER PUBLICATIONS

M. Hartwell, "Strong Electron Emission From Patterned Tin–Indium Oxide Thin Films", IEDM, 1975, pp. 519–521.

C.A. Spindt, "Physical Properties of Thin–Film Emission Cathodes with Molybdenum Cones", J. Applied Physics, vol. 47, No. 12, Dec. 1976, pp. 5248–5263.

C.A. Mead, "Operation of Tunnel–Emission Devices", Journal of Applied Physics, Apr. 1961, pp. 646—652.

R. Meyer, "Recent Development on "Microtips" Display at Leti", Technical Digest of IVMC 91, 1991, pp. 6–9.

* cited by examiner

METHOD FOR MANUFACTURING SPACER FOR ELECTRON SOURCE APPARATUS, SPACER, AND ELECTRON SOURCE APPARATUS USING SPACER

BACKGROUND OF THE INVENTION

1. Field of the Invention

The present invention relates to a method for manufacturing a spacer for an electron source apparatus, that spacer and an electron source apparatus using that spacer.

2. Related Background Art

As an electron emission device, two types of devices, i.e., a hot cathode device and a cold cathode device have been conventionally known. In regard to the cold cathode device, for example, a surface conduction emission device, a field emission device (which will be referred to as an FE hereinafter), a metal/insulation layer/metal emission device (which will be referred to as an MIM type hereinafter) are known.

As to the surface conduction emission device, for example, M. I. Elinson, Radio Eng. Electron Phys., 10, 1290, (1965) or another example which will be described later are known.

The surface conduction emission device utilizes a phenomenon such that an electric current is caused to flow through a thin film, which is formed on a substrate and has a small area, in parallel to the film surface to generate electron emission. As such a surface conduction emission device, there are reported a device using an Au thin film [G. Dittmer, "Thin Solid Films", 9,317 (1972)], a device using an $In_2O_3/SnO_2$ thin film [M. Hartwell and C. G. Fonstad, "IEEE Trans. ED Conf.", 519 (1975)], a device using a carbon thin film [Hisashi Araki and et al., "Shinku (Vacuum)", Vol. 26, No. 1, 22 (1983)] and others as well as the above-described device using the $SnO_2$ thin film by Elinson and et al.

As a typical example of the device structure of these surface conduction emission device, FIG. 9 shows a top plan view of the above-mentioned device by M. Hartwell and et al. In this drawing, reference numeral 3001 denotes a substrate and 3004 designates a conductive thin film consisting of a metal oxide formed by the spattering method. The conductive thin film 3004 is made into an H-shaped planar form as shown in the drawing. When an electric process called an electric forming which will be described later is applied to this conductive thin film 3004, an electron emission section 3005 is formed. In the drawing, a distance L is set to 0.5 to 1 [mm] and a width W is set to 0.1 [mm]. Incidentally, although the electron emission section 3005 is illustrated in the rectangular form in the center of the conductive thin film 3004 for the sake of convenience, this is typical and the actual position or shape of the electron emission section are not faithfully shown.

In the above-described surface conduction emission device including the device by M Hartwell and others, it is general to form the electron emission section 3005 by performing the electric process called the electric forming with respect to the conductive thin film 3004 before carrying out electron emission. That is, the electric forming means that a constant direct-current voltage or a direct-current voltage which boosts at a very slow rate of, e.g., approximately 1 V/minute to the both ends of the conductive thin film 3004 to turn on electricity and the conductive thin film 3004 is locally fractured, deformed or transformed so that the electron emission section 3005 having an electrically high resistance is formed. It is to be noted that a crack is generated to a part of the locally fractured, deformed or transformed conductive thin film 3004. When an appropriate voltage is applied to the conductive thin film 3004 after the electric forming, electron emission occurs in the vicinity of the crack.

As an example of the FE, for example, W. P. Dyke & W. W. Dolan, "Field emission", Advance in Electron Physics, 8, 89 (1956) or C. A. Spindt, "Physical properties of thin-film field emission cathodes with molybden um cones", J. Appl. Phys., 47, 5248 (1976) and the other are known.

As a typical example of the FE device structure, FIG. 10 shows a cross-sectional view of the device by C. A. Spindt and et al. In the drawing, reference numeral 3010 denotes a substrate; 3011, an emitter wiring consisting of a conductive material; 3012, an emitter cone; 3013, an insulation layer; and 3014, a gate electrode. This device causes field emission from a tip of the emitter cone 3012 by applying an appropriate voltage between the emitter cone 3012 and the gate electrode 3014.

As another structure of the FE device, there is an example where the emitter and the gate electrode are arranged on the substrate in substantially parallel to the flat surface of the substrate, which is different from the lamination structure shown in FIG. 10.

Further, as an example of MIM, for example, C. A. Mead, "Operation of tunnel-emission Devices", J. Appl. Phys., 32,646 (1961) and others are known.

FIG. 11 shows a typical example of the MIM device structure. FIG. 11 is a cross-sectional view, in which reference numeral 3020 denotes a substrate; 3021, a lower electrode consisting of a metal; 3022, a thin insulation layer having a thickness of approximately 100 Å; and 3023, an upper electrode consisting of a metal having a thickness of approximately 80 to 300 Å. In the MIM, the electron is emitted from the surface of the upper electrode 3023 by applying an appropriate voltage between the upper electrode 3023 and the lower electrode 3021.

Since the above-described cold cathode device can obtain electron emission at a lower temperature as compared with the hot cathode device, it requires no heater. Therefore, the cold cathode device has a structure simpler than that of the hod cathode device, and a finer device can be produced. A problem such as heat fusion of the substrate hardly occurs even if a plurality of devices are arranged on the substrate in the high density. Moreover, as different from the hot cathode device which has a low response speed because it operates by heat from the heater, the cold cathode device advantageously has a higher response speed.

Therefore, studies for applying the cold cathode device have been conducted at full blast. For example, since the surface conduction emission device has a very simple structure among the cold cathode devices and can be manufactured easily, a plurality of devices can be formed in a large area. Thus, as disclosed in Japanese Patent Application Laid-Open No. 64-31332 by the present applicant, a method for arranging plural devices to be driven has been studied.

Additionally, as to applications of the surface conduction emission device, for example, an image forming apparatus such as an image displaying apparatus or an image recording apparatus or a charged beam source and the like have been studied.

In particular, as an application to the image displaying apparatus, an image displaying apparatus using a combination of the surface conduction emission device and a fluorescent material which emits light by collision with electrons has been studied as disclosed in U.S. Pat. No. 5,066,883 by the present applicant or Japanese Patent Application Laid-Open Nos. 2-257551 and 4-28137. The image displaying apparatus using a combination of the surface conduction emission device and the fluorescent material is expected for the characteristic superior to that of the prior art image displaying apparatus adopting any other mode. For example, when comparing with a recently spread liquid crystal display apparatus, it can be said that the above-described image displaying apparatus is superior in that no back light is required because of the spontaneous light type or that a viewing angle is wider.

In addition, a method for arranging a plurality of FE devices to be driven is disclosed in U.S. Pat. No. 4,904,895 by the present applicant, for example. Further, as an example where the FE device is applied to the image displaying apparatus, for example, there is known a planar display apparatus reported by R. Mayer and et al. [R. Meyer: "Recent Development on Microtips Display at LETI", Tech. Digest of 4th Int. Vacuum Microelectronics Conf., Nagahama, pp. 6–9 (1991)]

Furthermore, Japanese Patent Application Laid-Open No. 3-55738 by the present applicant discloses an example where a plurality of MIM devices are arranged to be applied to the image displaying apparatus.

Among the above-described image forming apparatuses using electron emission device, the planar display apparatus having a thin depth does not occupy a large space and has a light weight, and hence this apparatus attracts attention as a substitute for a cathode-ray tube display apparatus.

There is proposed a planar display panel section which accommodates in an airtight container an electron source substrate having the above-described electron emission devices arranged in the form of a matrix, and the inside of the airtight container is maintained at a degree of vacuum of approximately $10^{-6}$ [torr]. Therefore, as the display area of the display panel increases, means for preventing deformation or fracture of a rear plate and a face plate due to a difference in air pressure between the inside of the airtight container and the outside must be provided. As a countermeasure, a structure support (which is referred to as a spacer or a lib) which consists of a relatively thin glass plate and withstands the ambient pressure is provided between the electron source substrate and the face plate.

SUMMARY OF THE INVENTION

It is an object of the present invention to realize a simple and preferable manufacturing method as a method for manufacturing a spacer for an electron source apparatus and to realize a preferable electron source apparatus by that spacer.

To achieve this aim, a method for manufacturing a spacer for an electron source according to the present invention has the following structure.

A method for manufacturing a spacer for use in an electron source apparatus comprising an electron source having an electron ray emission device, an opposing member opposed to the electron source and a spacer provided between the electron source and the opposing member, comprises a coating step for providing a film to a spacer substrate constituting the spacer, the coating step including a step for bringing a preformed film type material into contact with the spacer substrate.

According to the present invention, when the film material is not directly given to the spacer substrate but the previously formed film type material is used as a material of the film, a degree of freedom for forming the film is improved and, for example, the environmental condition for forming the film and the like is eased. It is to be noted that the film type material is such a material as that only the film type material as a simple substance enables conveyance of the film type material or supply to the spacer substrate and is used in the state where it is superimposed on a base material. Any film type material may be used as long as a change in thickness of the film type material generated during use (for example, when moving the film type material) or a generated thickness distribution are suppressed in an allowable range.

Further, as a shape of the spacer, a tabular shape (rectangular solid) and a pillar shape are preferable, and FIG. 1 shows a tabular spacer substrate 201.

Here, it is preferable that the film type material is not directly used as a film but a material contained in the film type material forms a final film in the coating step. For example, when the film type material is heated above a room temperature, a film including a material contained in the film type material can be formed on the substrate. In addition, the film type material may be heated by heat applied from the outside after being brought into contact with the spacer substrate or may be heated by the preheated spacer substrate. Or, these heating methods may be combined to be used.

Furthermore, the film type material may be heated by heat given by light irradiation.

In particular, heating by irradiation of a laser beam is preferable because an irradiation position and an irradiation area of the laser beam can be easily controlled so that a minute area can be heated.

Further, in each aspect of the present invention, the film may have conductivity.

Additionally, in each aspect of the present invention, the film type material may be formed by developing a material in the film type material on a development substrate. The development substrate preferably has a flat shape. The film type material may be removed from the development substrate, and the film type material may be removed either before or after being brought into contact with the spacer substrate. Further, the film type material which can be obtained by developing a material contained therein on the development substrate in the liquid state can be preferably adopted. The material of the film type material may contain a binder or a solvent or contain both the binder and the solvent. The material of the film type material may contain a starting material which is pyrolytically decomposed. Additionally, the film type material may be obtained by developing the material of the film type material on the development substrate and thereafter conducting a step for processing the developed material. As the step for processing the developed material, there is, for example, a drying step. When using a liquid material as the material in the film type material, it is desirable for handling the film type material as a simple substance to perform processing for imparting a strength enabling handling as a simple substance after development. Further, after forming the film type material, it is desirable to execute a process for increasing the viscosity in order to suppress a change in thickness of the film type material generated before contacting with the spacer substrate and a generated thickness distribution to an allowable range. When the film type material is not handled as a simple substance but used in the state where it is superimposed on the base material, since the strength of the base material can be expected, the strength of the film type material may be lower than that of the material handled as a simple substance. However, in this case, it is also desirable to conduct a process for increasing the viscosity after development in order to suppress a change in thickness of the film type material generated before contacting with the spacer substrate and/or a generated thickness distribution to an allowable range. As such a processing step, a drying step is preferable. In particular, a stoving step for heating above a room temperature is preferable. However, if the material in the film type material contains a material to be pyrolytically decomposed and decomposition of the material which is pyrolytically decomposed is carried out by heat given after the film type material is brought into contact with the spacer substrate, it is desirable to select a condition which hardly causes pyrolytical decomposition of that material when heating for drying. It is also desirable that the film has the conductivity and a material in the film type material contains at least a conductive substance. As the conductive substance, one selected from $SnO_2$, ZnO, $In_2O_3$ and Ag can be preferably used. Further, the film has the conductivity and, as the material in the film type material, one containing at least a starting material for forming a conductive substance by thermal decomposition can be preferably adopted.

As the starting material, metal carboxylate or metal alcoholate can be preferably adopted.

Moreover, in each aspect of the present invention, the film type material may be brought into contact with the spacer substrate in the state where the film type material is superimposed on a base material. When the film type material can be obtained by developing a material in the film type material on the development substrate, the development substrate can be used as the base material.

In each aspect of the present invention, the contacting step is preferable if it is a step for bringing one film type material into contact with a plurality of spacer substrates. In particular, it is desirable that a plurality of spacer substrates are bundled to be brought into contact with one film type material. Further, the bundled plural spacer substrates may be preferably aligned in such a manner that a portion for providing a film thereto forms a flat surface. In addition, it is preferable to use a bundling jig for bundling a plurality of spacer substrates so as not to cover the portion for forming the film. In particular, it is preferable to employ a jig having a structure for sandwiching the both sides of the plural spacers to be bundled.

In each aspect of the present invention, the contacting step may be a step for bringing the spacer substrate into contact with the film type material, a holding jig having a hole for accommodating the spacer substrate therein, the hole having such a structure as that the film forming portion of the spacer is exposed when the spacer substrate is inserted into the hole, the spacer substrate being accommodated in the hole of the holding jig. In order to expose the film forming portion of the spacer substrate, for example, the hole may have a such a depth as that the film forming portion of the spacer substrate is exposed. In the structure for accommodating the spacer substrate in the hole as described above, it is preferable that the holding jig has a plurality of the holes and a plurality of spacer substrates are simultaneously brought into contact with the film type material.

In each aspect of the present invention, the coating step may be a step for providing the film to only a part of the spacer substrate.

In each aspect of the present invention, the coating step may be a step for providing the film on a contact surface of the spacer substrate on the electron source side or a contact surface of the same on the opposing member side or the both contact surfaces on the electron source side and the opposing member side.

Moreover, one method for manufacturing a spacer according to the present invention is constituted as follows.

When the opposing member is used as a target to which an electron outputted from the electron source is irradiated, a contact surface at the electron source side at the spacer substrate or a contact surface of the opposing member side is not limited to a contact surface to the electron source of the spacer substrate or a contact surface to the opposing member. For example, between the electron source and the target of the electron outputted from the electron source, an intermediate member such as for example grid electrode or another control electrode is provided, as a process step for forming a film at the contact surface between the spacer substrate and the intermediate member, the above manufacturing method of the present invention may be used.

A method for manufacturing a spacer for use in an electron source apparatus comprising an electron source having an electron ray emission device, opposing members opposed to the electron source and a spacer provided between the electron source and the opposing members, comprises a coating step for providing a film to a spacer substrate constituting the spacer, the coating step including: a supplying step for supplying a material of the film to the spacer substrate; and a position selective film forming step for forming a film with the supplied material at only a predetermined position of the spacer substrate.

In case of the present invention, since the step for forming a film with the supplied material at only a predetermined position after supplying the material is provided, the accurate position control during the material supply is not necessary. Although the present invention is not restricted to a range of each aspect of the present invention, the combined use of these aspects is preferable.

The film is obtained by heating the supplied material, and the position selective film forming step is preferable if it is a step for selectively heating the supplied material at the predetermined position. Only the position at which the film should be formed may be heated to a temperature at which the film can be satisfactorily formed. However, the structure that the material supplied to a position where no film is formed is heated is not eliminated and, in such a case, there occurs no problem if the material supplied to the position where no film is formed may not be heated under the condition for satisfactorily forming the film.

The selective heating can be attained by light irradiation and irradiation of a laser beam in particular. The selective heating can be also conducted by using a heater including a heat source section having a shape corresponding to a selective heating position.

Further, the present application includes the invention of a spacer manufactured by using a method defined in any of the above aspects of the present invention. In particular, when an antistatic film is provided to the spacer substrate, the invention of this application can be preferably adopted. Especially, it is preferable that a film for moving electric charge is provided to the spacer substrate and the film provided in the coating step is electrically connected to the film for moving the electric charge.

Here, when the film for moving the electric charge (which is also referred to as a high resistance film or an antistatic film in the specification of this application) is provided to the spacer substrate, the electric charge or the influence of the electric charge can be suppressed. In particular, when an electric current is caused to flow between an electrode provided to the electric source and an electrode provided to the opposing member through the film for moving the electric charge, an amount of electro static charge can be suppressed. The film provided in the coating step may be electrically connected to the film for moving the electric charge. Specifically, as the film provided in the coating step, there can be preferably used one which can uniformizing the potential of the film for moving the electric charge by its existence. When a resistance value of the film provided in the coating step or a sheet resistance value in particular is set to be smaller than that of the film for moving the electric charge, the effect for uniformizing the potential of the film for moving the electric charge can be preferably obtained. It is desirable that the sheet resistance value of the film provided in the coating step is not more than 1/10 of the sheet resistance value of the film for moving the electric charge or the entire spacer and not more than $10^7$ [Ω/□].

Here, as the material of the film for moving the electric charge, tin oxide, indium oxide, a mix crystal thin film of these substances, a Cr—Al alloy nitride film, a metal oxide film, amorphous carbon and others are used taking into consideration a combination with the film provided in the coating step. The film for moving the electric charge may be formed by the spattering method, the reactive spattering method, the ion plating method, the electron beam evaporation method, the ion assist evaporation method and others.

In the above-described spacer according to the present invention, it is preferable that the sheet resistance value is not less than $10^7$ [Ω/□] and not more than $10^{14}$ [Ω/□]. Further, it is preferable that the spacer substrate is an insulating material. It is also preferable that the material of the spacer substrate is glass or ceramics.

In addition, this application provides, as one aspect of an electron source apparatus according to the present invention, an electron source apparatus comprising: an electron source having an electron emission device, an opposing member opposed to the electron source; and a spacer provided between the electron source and the opposing member, the spacer being any of the above-described spacers according to the present invention.

Further, this application includes, as another aspect of the electron source apparatus according to the present invention, the invention having the following structure.

An electron source apparatus comprises: an electron source having an electron emission device; an opposing member opposed to the electron source; and a first member provided between the electron source and the opposing member, the first member being manufactured by a manufacturing method comprising a coating step for providing a film to a substrate of the first member, the coating step including a step for bringing a preformed film type material into contact with the substrate of the first member.

It is to be noted that each aspect of the above-described spacer manufacturing method according to the present invention is very preferable when applied to production of the spacer but it can be preferably applied as a method for manufacturing a member provided between the electron source and the opposing member in the electron source apparatus as well as the spacer.

Moreover, this application includes the invention having the following structure as still another aspect of the electron source apparatus according to the present invention.

An electron source apparatus comprises an electron source having an electron ray emission device; an opposing member opposed to the electron source and a first member provided between the electron source and the opposing member, the first member being manufactured by a manufacturing method comprising a coating step for providing a film to a substrate of the first member, the coating member including: a supply step for supplying a material of the film to the substrate of the first member; and a position selective film formation step for forming a film with the supplied material at only a predetermined position of the substrate of the first member.

Further, in each aspect of the electron source apparatus according to the present invention, the opposing member may include a fluorescent material which emits light by irradiation of an electron emitted by the electron emission device. As the electron emission device, a cold cathode device can be preferably adopted. Additionally, as the cold cathode device, an electron emission device having a conductive film including an electron exposure section between electrodes is preferable, and a surface conduction electron emission device is particularly preferable.

DETAILED DESCRIPTION OF THE PREFERRED EMBODIMENTS

Figure 1:
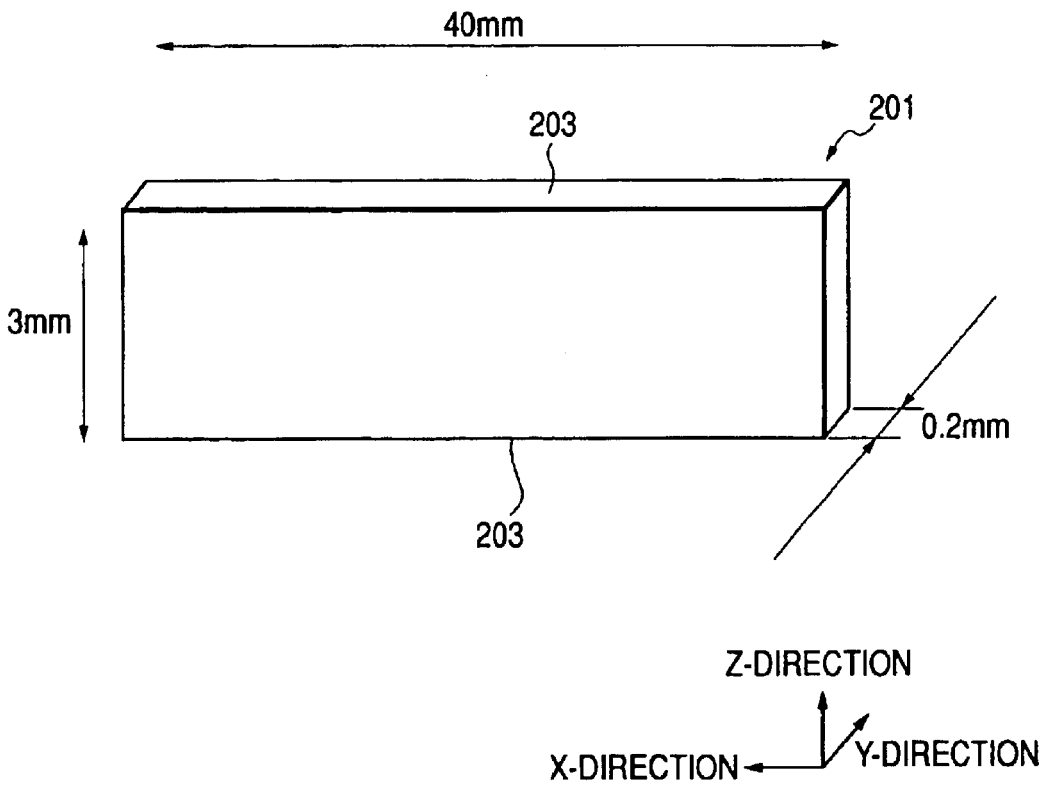
FIG. 1 is a view for explaining a shape of a spacer according to an embodiment of the present invention.

Concrete examples of problems which can be improved by the present invention will be first explained hereinbelow.

In the first place, when a part of electrons emitted from an electron emission device in the vicinity of a spacer is brought into contact with the spacer, or when ion ionized by the behavior of the emitted electrons adheres to the spacer, the spacer may be charged. An orbit of the electron emitted from the electron emission device is bent by electrification of the spacer, and the electron reaches a place different from a normal position on a fluorescent material provided on a face plate, thereby displaying an image in the vicinity of the spacer in the distorted manner.

In the second place, in order to accelerate the electron emitted from the electron emission device, a high voltage above several hundred V (i.e., a high electric field not less than 1 kV/mm) is applied between the electron source substrate and the face plate, and concerns about the creeping discharge on the surface of the spacer are hence raised. In particular, when the spacer is charged as described above, the discharge may be possibly induced.

In order to solve this problem, there is proposed removal of the electro static charge by flowing a very small current through the spacer (Japanese Patent Application Laid-Open Nos. 57-118355 and 61-124031). In this proposition, forming a high resistance film on the surface of an insulating spacer causes the very small current to flow through the spacer surface. The high resistance film (antistatic film) used in this example is a tin oxide film, a mixed crystal thin film consisting of tin oxide and indium oxide or a metal film.

Since multiple electrons are emitted depending on types of image, only the method for removing the electro static charge by the high resistance film is not enough for reducing the distortion of the image. This problem occurs because an electric connection between the spacer having the high resistance film and the upper and lower substrates, i.e., a face plate (which will be referred to as an FP hereinafter) and a rear plate (which will be referred to as an RP hereinafter) is not enough and the electro static charge is concentrated in the vicinity of the joining part of these members. As in the proposition (Japanese Patent Application Laid-Open No. 8-180821) for overcoming this problem, there is proposed that the electric contact with the upper and lower substrates is assured by forming a film at the joining part with the FP side and the RP side by using a metal such as platinum or a material having a high conductivity, e.g., a semiconductor film.

As a method for forming such a conductive film, metallization using a vapor phase film forming technique such as a spattering method or a resistance heat evaporation method is general. These methods have been used because the material composition design of a uniform mixed thin film can be experimentally facilitated. However, such a technique requires a vacuum depressurizing process and leads to a large problem of the cost for the mass production because of a large tact time for the batch processing, a large device cost, a low availability of materials and others. Therefore, there is required a production process capable of simply and inexpensively manufacturing such a conductive film in large quantities at a time.

Description will now be first given on a method for manufacturing a spacer used in an embodiment 1 and then on a structure and a manufacturing method of a display panel of an image display apparatus using that spacer.

(Embodiment 1)

The spacer used in the embodiment 1 is manufactured in the following manner. As shown in FIG. 1, soda lime glass having a 40 mm×3 mm thin sheet rectangular shape with a thickness of 0.2 mm is used as a spacer substrate 201. 3 mm corresponds to a thickness of the display panel. In this embodiment, the spacer substrate is manufactured by cutting the soda lime plate glass having a thickness of 0.2 mm. The present invention is not restricted to cut of the plate glass, and the glass may be processed into a desired shape by, for example, a heating drawing method. Further, X, Y and Z directions are determined as shown in FIG. 1.

A conductive film is then formed on a desired position on the spacer substrate.

The conductive film is formed on a 40 mm×0.2 mm surface represented by 203 in FIG. 1, i.e., a contact surface between the spacer and the upper and lower plates. This positional relationship will be described later in detail.

As a preparation for formation of the conductive film, a film type material is first produced. Its procedure is as follows.

(1) Carboxylate of Sn and acrylic resin as a binder are dissolved in xylene which is a solvent;
(2) this solution is spinner-applied on an appropriate substrate (a polytetrafluoroethylene substrate in this embodiment);
(3) it is dried in an oven at a temperature of 120° C. for 10 minutes; and
(4) it is removed from the polytetrafluoroethylene substrate.

By this procedure, there is obtained a film type material in which the carboxylate of Sn is dispersed in the binder (acrylic resin). A mixture ratio of the Sn carboxylate to the acrylic resin is 1:1 in terms of a weight ratio, and a mixture ratio of the mixture of the Sn carboxylate and the acrylic resin to xylene is 3:7 in terms of a weight ratio.

The film type material is then used to form the conductive film on a desired position on the spacer substrate. Its procedure is as described below (see FIGS. 2A to 2C).

Figure 2A:
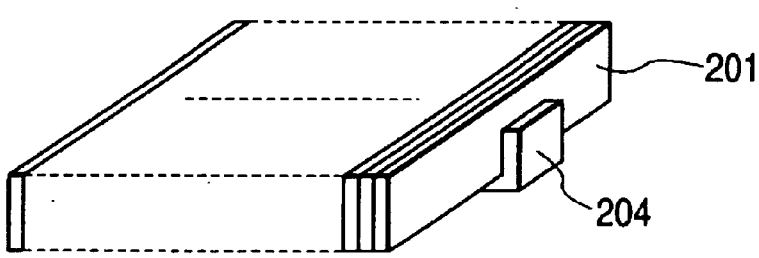
FIGS. 2A, 2B and 2C are views showing a method for providing a conductive film of the spacer according to an embodiment 1 of the present invention.
Figure 2B:
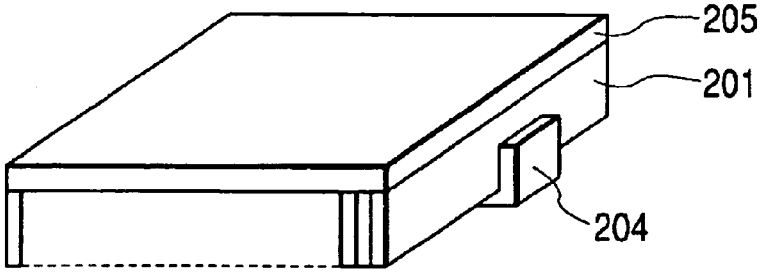
Figure 2C:
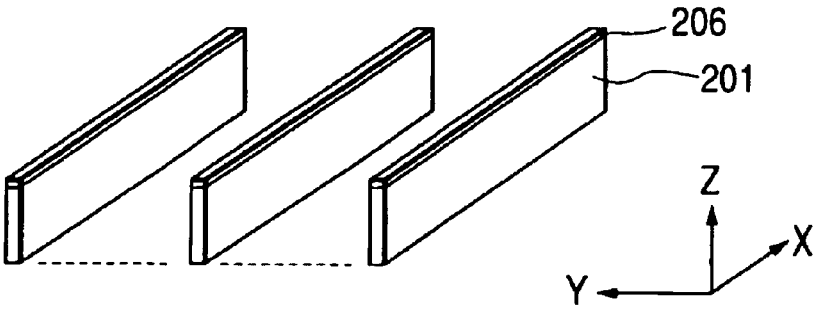

(1) 200 spacer substrates are bundled in such a manner that the film forming surfaces are aligned and become flat and they are fixed by an appropriate bundling jig 204 (FIG. 2A);
(2) a film type material 205 cut into a shape (40 mm×40 mm) substantially the same as that of the film forming surface is attached (FIG. 2B);
(3) they are baked in an oven at 450° C. for two hours; and
(4) the temperature is reduced to a room temperature, and the bundling jig 204 is then removed to separate the substrates from each other one by one (FIG. 2C).

During the calcination, the binder in the film type material is removed and $SnO_2$ is formed by the pyrolysis reaction.

With these operations, 200 spacer substrates 201 having the conductive film 206 formed on one of the contact surfaces can be obtained at a time.

Further, the positional relationship between the spacer substrate 201 and the film type material 205 can be inverted in the above-described procedure, namely the bundled spacer substrates 201 may be mounted on the underlying film type material 205.

When these film forming operations are again carried out with respect to the opposed surface, the spacer substrate 201 having the conductive films 206 formed on the both contact surfaces can be formed.

When the bundled spacer substrates 201 are mounted on the underlying film type material 205 and the product obtained by attaching another film type material 205 thereon is baked, the films can be simultaneously formed on the both surfaces.

Then, after separating the spacer substrates 201 from each other, targets of Cr and Al are simultaneously spattered by using a high frequency power supply as a high resistance film (antistatic film) 11 on the surface of the spacer substrate 201 (see FIG. 8), thereby forming a Cr—Al alloy nitride film having a film thickness of 200 nm. The spatter gas used in this process is a mixed gas whose ratio of $Ar:N_2$ is 1:2 and a full pressure is 10 [mTorr]. The sheet resistance R of the simultaneously formed films under the above-described condition is $2\times10^{11}$ [Ω/□]. The present invention is not restricted to this, and various kinds of high resistance film (antistatic film) can be used in this embodiment.

The spacer is manufactured in the above-mentioned manner.

Description will now be given as to a method for manufacturing a display panel according to the present invention using the above spacer.

Figure 6:
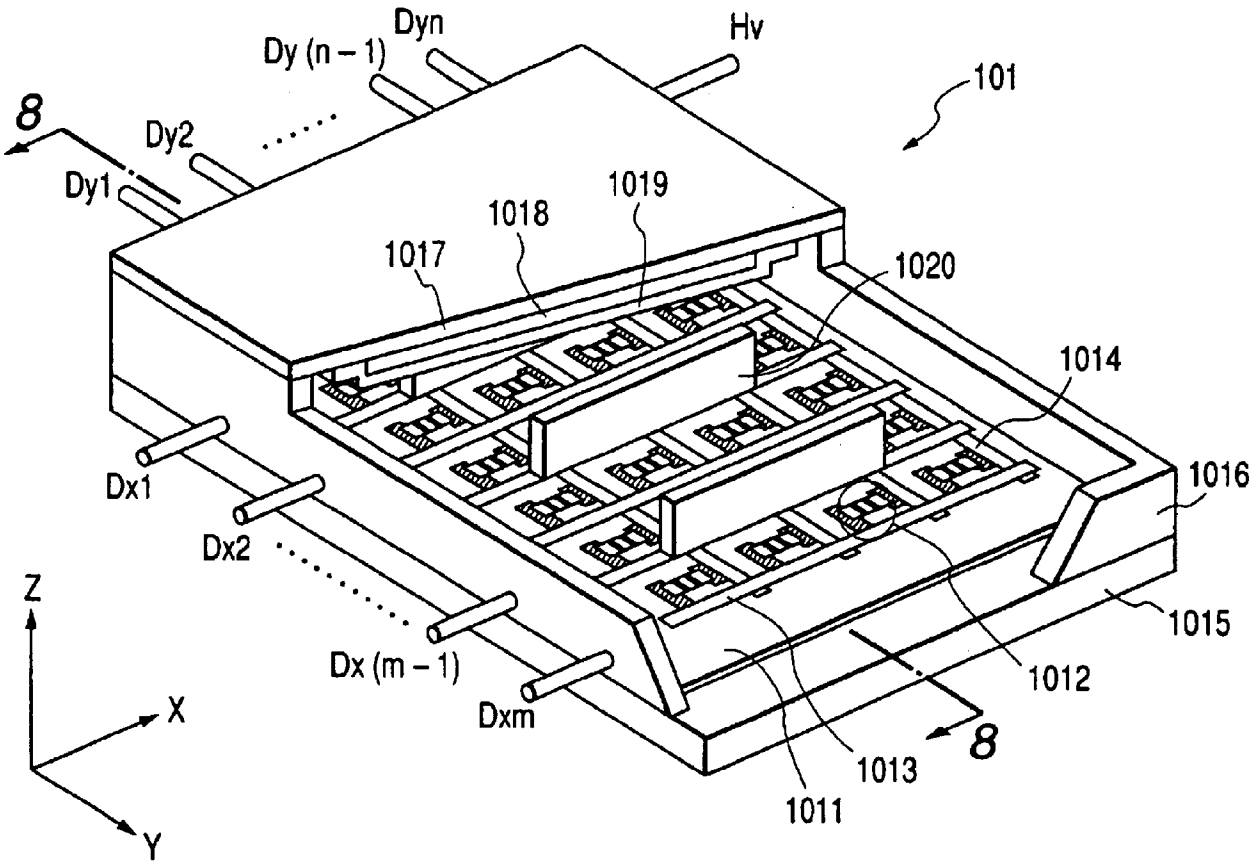
FIG. 6 is a partially cut perspective view of a display panel of an image displaying apparatus according to an embodiment of the present invention.
Figure 7:
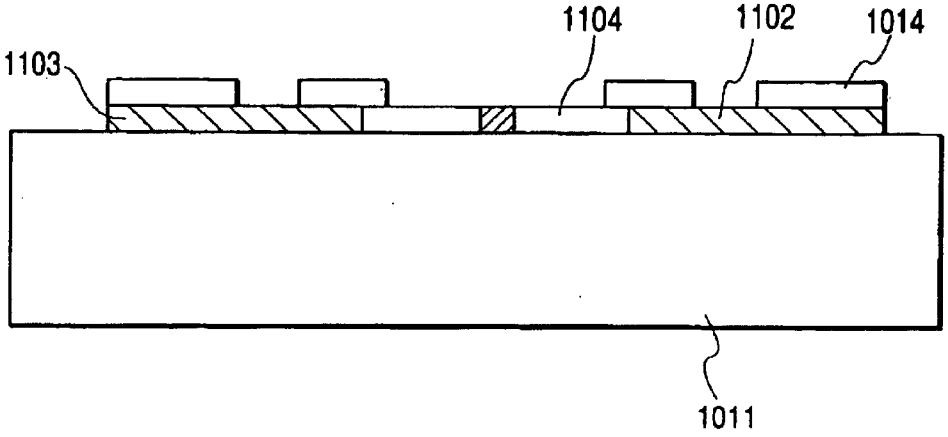
FIG. 7 is a cross-sectional view of a surface conduction emission device according to the embodiment of the present invention.

FIG. 6 is a perspective view showing an appearance of a display panel 101 used in this embodiment and illustrates a partially cut display panel 101 for depicting the inner structure thereof. FIG. 7 is a cross-sectional view of one surface conduction device 1012 in a direction parallel to a line-direction wiring electrode 1013.

A substrate 1011 having a line-direction wiring electrode 1013, a row-direction wiring electrode 1014, an interlayer insulation layer (not shown), and device electrodes 1102 and 1103 and a conductive film 1104 for the surface conduction emission device formed thereon is connected to an RP 1015. A spacer 1020 produced by the above-described method is fixed on the lined-direction wiring 1013 of the substrate 1011 at equal intervals in parallel to the line-direction wiring 1013. Thereafter, an FP 1017 having a fluorescent screen 1018 and a metal back 1019 added on the inner surface thereof is provided above the substrate 1011 by approximately 5 mm through a side wall 1016, and respective joining parts of the RP 1015, the FP 1017, the side wall 1016 and the spacer 1020 are fixed. The joining part between the substrate 1011 and the RP 1015, that between the RP 1015 and the side wall 1016 and that between the FP 1017 and the side wall 1016 are sealed by applying frit glass (not shown) and being baked in the atmosphere at 400° C. to 500° C. for more than 10 minutes. The spacer 1020 is provided on the line-direction wiring 1013 (line width: approximately 300 μm) on the substrate 1011 side and on the metal back 1019 on the FP 1017 side through the conductive frit glass (not shown) in which conductive filler or a conductive material such as a metal is mixed, and it is bonded by being baked in the atmosphere at 400° C. to 500° C. for more than 10 minutes simultaneously with sealing of the airtight container. Also, the electrical connection is carried out.

The inside of the airtight container finished as described above is evacuated by a vacuum pump through an exhaust pipe (not shown) and reaches a sufficient degree of vacuum, and the electric power is thereafter supplied to each device through the line-direction wiring electrode 1013 and the row-direction wiring electrode 1014 by using container external terminals Dx1 to Dxm and Dy1 to Dyn to perform the above-described electric forming process, thereby manufacturing a multi electron source. Then, at a degree of vacuum of approximately $10^{-6}$ [Torr], the non-illustrated exhaust pipe is deposited by being heated by a gas burner in order to seal an envelope (airtight container). At last, a getter process is conducted to maintain the degree of vacuum after sealing.

In the above-described display panel, there is used a multi electron source wired in a matrix form (see FIG. 6) by n×m (n=3072, m=1024) surface conduction emission devices each having an electron emission section on the conductive fine-grained film between the electrodes, m line-direction wires and n row-direction wires.

The structure in the vicinity of the spacer will now be described in detail with reference to FIG. 8.

Figure 8:
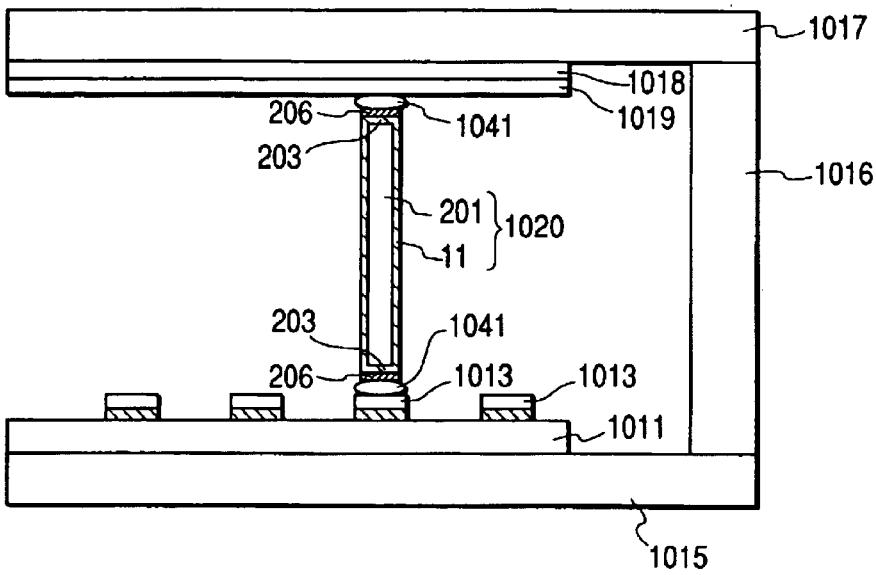
FIG. 8 is a cross-sectional view of the display panel taken along the 8—8 line in FIG. 6.
Figure 9:
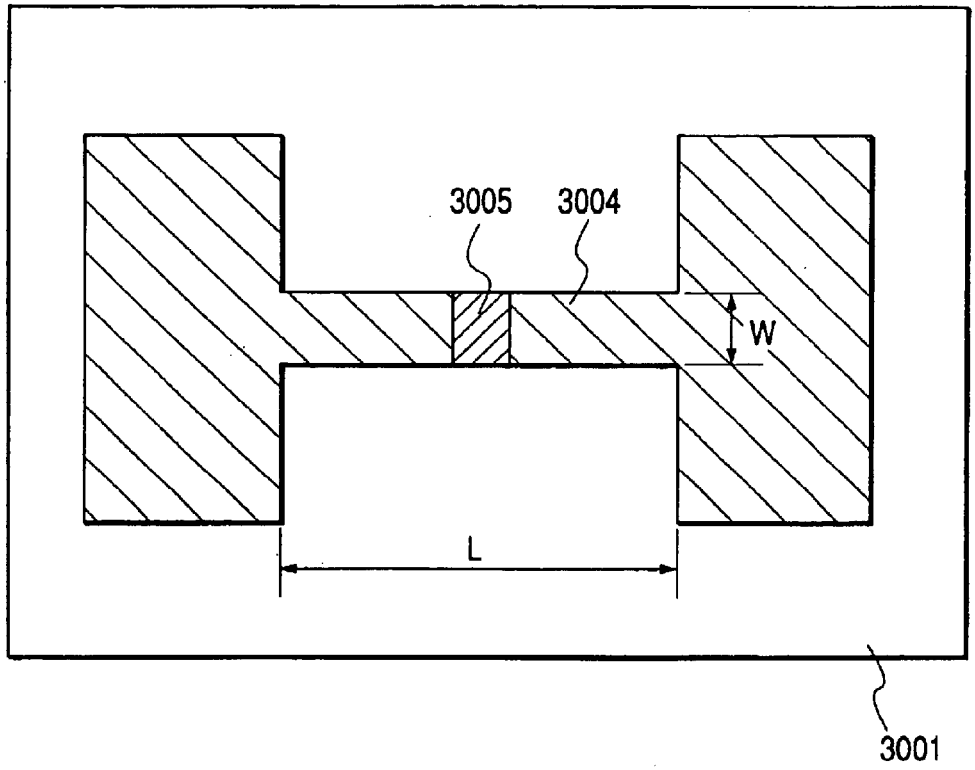
FIG. 9 is a view showing an example of a prior art surface conduction emission device.
Figure 10:
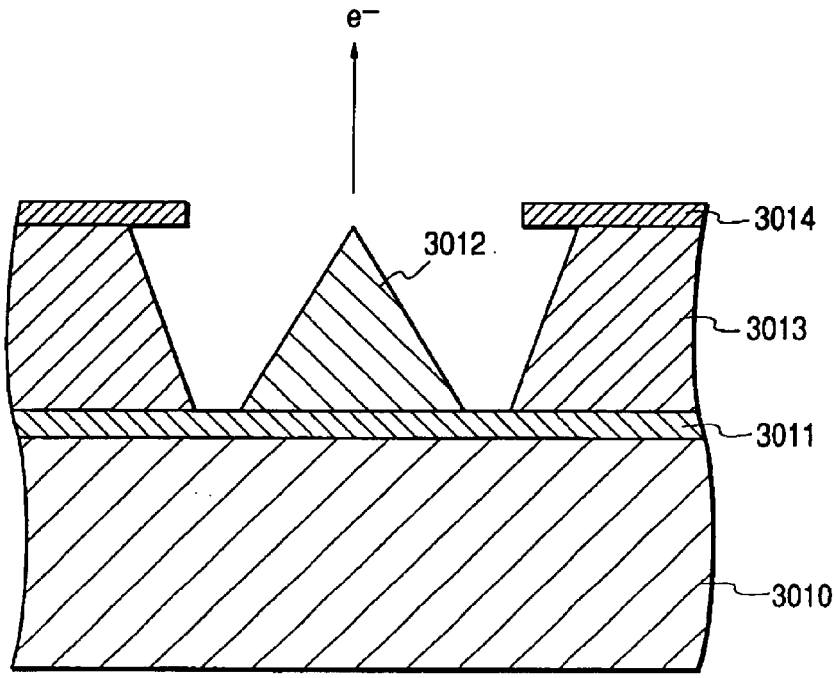
FIG. 10 is a view showing an example of a prior art FE device.
Figure 11:
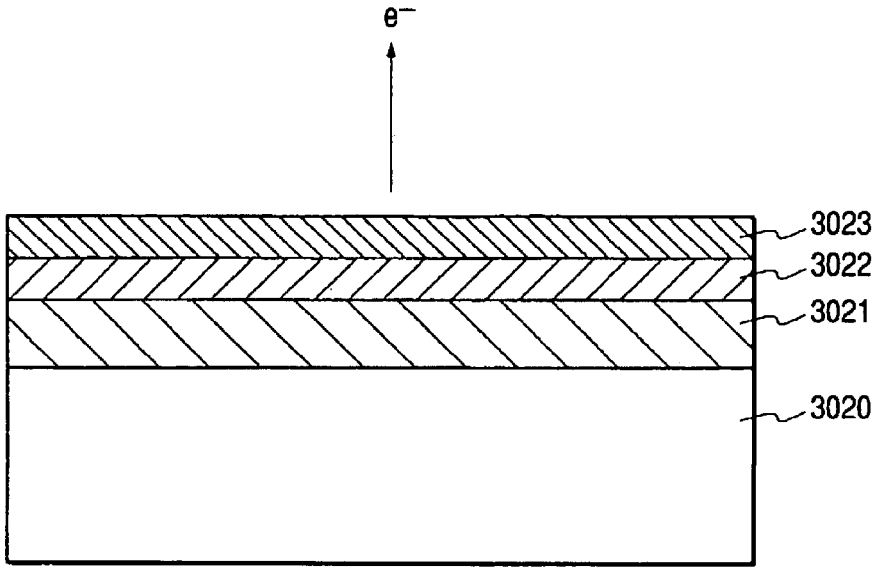
FIG. 11 is a view showing an example of a prior art MIM device.

FIG. 8 is a cross-sectional type drawing taken along 8—8 in FIG. 6, and each reference numeral denote the corresponding part in FIG. 6.

The spacer 1020 is a member having the antistatic high resistance film 11 formed on the surface of the spacer substrate 201 and having the conductive film 206 formed on the contact surface 203 of the spacer facing to the inner side of the FP 1017 (the metal back 1019 and others) and the surface of the substrate 1011 (the line-direction wiring 1013 or the row-direction wiring 1014) by the above-described method, and the spacers 1020 are disposed in a number required for attaining the aerotolerant structure and provided at necessary intervals. Further, they are fixed to the inner side of the FP 1017 and the surface of the substrate 1011 by a bonding material 1014. In addition, the high resistance film 11 is formed on the surface of the spacer 201 at a part exposed to at least the vacuum in the airtight container and electrically connected to the inner side of the FP 1017 (the metal back 1019 and others) and the surface of the substrate 1011 (the line-direction wiring 1013 or the row-direction wiring 1014) through the conductive film 206 on the spacer 1020 and the bonding material 1041. In the mode described herein, the spacer 1020 has a tabular form and is provided in parallel to the line-direction wires 1013 and electrically connected to the line-direction wires 1013. It is desirable that the spacer 1020 has an insulating property for being capable of withstanding a high voltage applied between the line-direction and row-direction wires 1013 and 1014 on the substrate 1011 and the metal back 1019 on the inner surface of the FP 1017 and also has the conductivity for preventing electrification to the surface of the spacer 1020.

The spacer substrate 201 is not restricted to the soda lime glass and, for example, quartz glass, glass in which a content of an impurity such as Na is reduced, a ceramics member such as alumina can be used as the spacer substrate 210. It is to be noted that the coefficient of thermal expansion of the spacer substrate 201 may be preferably close to that of a member constituting the airtight container and the substrate 1011.

Although the high resistance film 11 and the conductive film 206 are produced by the above-described method, they can be appropriately selected in accordance with the following basis.

An electric current obtained by dividing an accelerating voltage Va applied to the FP 1017 (metal back 1019 and others) on the high potential side by a resistance value Rs of the high resistance film 11 which is an antistatic film is caused to flow through the high resistance film 11 of the spacer 1020. Accordingly, the resistance value Rs of the spacer 1020 is set to a desirable range for the anti-electrification and the electric power consumption. In view of the anti-electrification, the sheet resistance is preferably not more than $10^{14}$ [Ω/□]. Further, it is preferably not more than $10^{12}$ [Ω/□] in order to obtain the sufficient antistatic effect. Although the lower limit of the sheet resistance depends on a shape of the spacer 1020 and a voltage applied between the respective spacers 1020, it is preferably not less than $10^{7}$ [Ω/□].

A thickness t of the high resistance film (antistatic film) formed on the spacer substrate 201 is desirably set in a range of 10 nm to 1 μm. Although the thickness of the high resistance film (antistatic film) depends on the surface energy of a material of the spacer substrate 201 and the contact with the substrate or a substrate temperature, the thin film having a thickness of not more than 10 nm is generally island shaped and has the unstable resistance and the poor reproducibility. On the other hand, the film thickness t of not less than 1 μm increases the film stress, and the film peeling may possibly occur, thereby deteriorating the productivity due to the long film formation time.

Accordingly, the film thickness of the high resistance film (antistatic film) is desirably 50 to 500 nm. The sheet resistance is ρ/t and a specific resistance ρ of the high resistance film (antistatic film) is preferably 10[Ω.cm] to $10^{8}$[Ω.cm] based on a preferable range of the sheet resistance and the film thickness t. Further, in order to realize a preferable range of the sheet resistance and the film thickness t, ρ should be $10^{4}$[Ω.cm] to $10^{6}$[Ω.cm].

The sheet resistance value of the conductive film is desirably lower than the sheet resistance value of the high resistance film by one or more figures because the electric charge accumulated in the spacer must be rapidly flowed, and it is desirable not more than $10^7$ [Ω/□].

Further, even in a case where the high resistance film is not formed on the surface of the spacer, it is preferable that the sheet resistance value of the conductive film is lower than that of the spacer substrate by one or more figures and an absolute value is not more than $10^7$ [Ω/□]

As described above, since an electric current flows through the high resistance film (antistatic film) formed on the spacer 1020 or the entire display panel 101 generates heat during the operation, a temperature of the spacer 1020 increases. If a resistance temperature coefficient of the high resistance film (antistatic film) is a large negative value, the resistance value is lowered when the temperature rises, and an electric current flowing through the spacer 1020 increases to again cause a temperature up. The electric current keeps to increase over the limit of the power supply. A value of the resistance temperature coefficient with which the excursion of the electric current occurs is experientially a negative value and its absolute value is not less than 1%. That is, the resistance temperature coefficient of the high resistance film (antistatic film) is desirably more than −1%.

As a material of the high resistance value 11 having the antistatic characteristic, a metal oxide can be used for example. Among the metal oxides, chrome, nickel or copper oxide is a preferable material. That is because such an oxide has a relatively small secondary electron emission efficiency and, even if the electron emitted from the electron emission device 1012 is brought into contact with the spacer, it is hardly charged. Besides the metal oxide, carbon has a small secondary electron emission efficiency and is a preferable material. In particular, since the amorphous carbon has a high resistance value, the resistance of the spacer 1020 can be easily controlled to a desired value.

As another material of the high resistance film 11 having the antistatic characteristic, a nitride of aluminum and a transition metal alloy is a preferable material since the resistance value of a good conductor to that of an insulating material can be controlled in a wide range by adjusting a composition of the transition metal. Further, the nitride of aluminum and the transition metal alloy has a resistance value which hardly changes in a later-described step for manufacturing the display device and it is hence a stable material. Additionally, its resistance temperature coefficient is a value larger than −1% and such a nitride is a practically easy-to-use material. As the transition metal element, there are Ti, Cr, Ta and others.

The alloy nitride film is formed on the insulating member by thin film forming means such as reactivity spattering, electron beam evaporation, ion plating, ion assist evaporation and the like. Although the metal oxide film can be manufactured by using the similar thin film forming method, oxygen gas substitutes for nitrogen gas in this case. Besides, the metal oxide film can be formed by the CVD method and the alkoxide applying method. The carbon film is produced by the evaporation method, the spattering method, the CVD method and the plasma CVD method and, when amorphous carbon is manufactured in particular, hydrogen needs to be contained in the atmosphere during the film formation or hydrocarbon gas is used as the film forming gas.

The conductive film 206 for constituting the spacer 1020 is provided for electrically connecting the high resistance film 11 to the FP 1017 (metal back 1019 and the like) on the high potential side and the substrate 1011 (wires 1013, 1014 and the like) on the low potential side.

At least any of the following plural effects can be expected for the conductive film provided to the spacer.

(1) A potential distribution of the high resistance film 11 is uniformized.

The electron emitted from the electron emission device 1012 forms an electron orbit in accordance with the potential distribution formed between the FP 1017 and the substrate 1011. The entire potential distribution of the high resistance film 11 must be controlled in order not to generate any disturbance in the electron orbit in the vicinity of the spacer 1020. When the high resistance film 11 is directly connected to the FP 1017 (metal back 1019 and the like) and the substrate 1011 (wires 1013, 1014 and the like) or connected to them through a contact member 1041, irregularity is generated in the connection state because of the contact resistance on the connecting portion boundary face, and the potential distribution of the high resistance film 11 may possibly deviate from a desired value. In order to prevent this from occurring, the conductive film 206 having a low resistance is provided over the entire length of a spacer end (contact surface 203) at which the spacer 1020 is brought into contact with the FP 1017 and the substrate 1011 and a desired potential is applied to the conductive film portion, thereby enabling control over the overall potential of the high resistance film 11.

(2) The high resistance film 11 is electrically connected to the FP 1017 and the substrate 1011.

As described thus far, the high resistance film 11 is provided for preventing electrification on the surface of the spacer 1020 and, when the high resistance film 11 is directly connected to the FP 1017 (metal back 1019 and the like) and the substrate 1011 (wires 1013, 1014 and the like) or connected to them via the contact member 1041, a large contact resistance is generated on the connecting portion boundary face, and the electric charge produced on the surface of the spacer can not be rapidly removed in some cases. To avoid this, the conductive film 206 having a low resistance is provided on the contact surface 203 of the spacer 1020 which is brought into contact with the FP 1017, the substrate 1011 and the contact member 1041.

The conductive film 206 is not restricted to materials used in this embodiment but can be produced from a film type material, and a material having a lower resistance value than that of the high resistance god film 11 can be selected.

Further, the binder or the solvent are not restricted those disclosed above.

For example, when Sn alcoholate instead of Sn carboxylate and octane instead of xylene are used in the above embodiment, the similar $SnO_2$ film can be formed.

In the image display apparatus using the finished display panel 101 such as shown in FIG. 6, a scan signal and a modulation signal are respectively applied to each cold cathode device (surface conduction emission device) 1012 via the container external terminals Dx1 to Dxm and Dy1 to Dyn to emit the electron; a high voltage is applied to the metal back 1019 via the high voltage terminal Hv so that the emission electron beam is accelerated and the electron collides with the fluorescent screen 1018; and each colored fluorescent material (R, G, B) is excited and caused to emit light to display an image. Incidentally, the voltage Va to the high voltage terminal Hv is applied in a range of 3[kV] to 10[kV] to a limit voltage with which discharge occurs, and the voltage Vf applied between the respective wires 1013 and 1014 is 14[V], When the continuous driving is possible by applying a voltage not less than 8 kV to the high voltage terminal Hv, it is determined that the withstand voltage is excellent.

In this embodiment, discharge does not occur until the 9 KV driving in the vicinity of the spacer 1020 under the above-described driving condition. Further, a light emission spot lines including light emission spots caused by the electron emitted from the cold cathode device 1012 in the vicinity of the spacer 1020 are formed at equal intervals in the two-dimensional manner, and a clear color image having the good color reproducibility can be displayed. This means that the distortion in the electric field which affects the electron orbit is not generated even if the spacer 1020 is provided.

(Embodiment 2)

The spacer used in the embodiment 2 is produced as follows. Each reference numeral corresponds to each part in the embodiment 1.

In this embodiment, an alumina substrate is used as the spacer substrate 201. Its dimension is the same as that in the embodiment 1.

The conductive film 206 is then formed at a desired position (equal to that in the embodiment 1) on the spacer substrate 201.

As a preparation for formation of the conductive film, the film type material 205 is first produced. Its procedure is described as follows.

(1) The $SnO_2$ fine particles and ethylcellulose as the binder are dissolved in turpentine oil which is a solvent;

(2) this liquid solution is applied on an appropriate substrate (polytetrafluoroethylene substrate in this embodiment) by the screen printing method;

(3) it is dried in an oven at 120° C. for 10 minutes; and (4) it is removed from the polytetrafluoroethylene substrate.

With this procedure, the film type material 205 having the $SnO_2$ fine particles dispersed in the binder (ethylcellulose) is finished. A mixture ratio of the $SnO_2$ fine particles and the ethylcellulose is 2:1 in terms of a weight ratio, and a mixture ratio of a mixture of the $SnO_2$ fine particles and the ethylcellulose to the turpentine oil is 3:7 in terms of a weight ratio.

The film type material 205 is then used to form a conductive film 206 at a desired position of the spacer substrate 201. Its procedure is similar to that in the embodiment 1 (see FIGS. 2A to 2C), and the binder in the film type material is removed during the calcination to form the $SnO_2$ film. When such a film is dried, a spacer having the conductive film formed on one of the contact surfaces can be obtained.

As similar to the embodiment 1, the positional relationship between the spacer substrate 201 and the film type material 205 may be inverted.

When these film formation operations are again carried out with respect to the opposed surface, a spacer having the conductive films formed on the both contact surfaces can be formed.

Further, the films can be simultaneously formed on the both sides as similar to the embodiment 1.

Thereafter, the high resistance film (antistatic film) is formed on the surface of the spacer substrate 201 by the method similar to that in the embodiment 1, and the spacer 1020 according to this embodiment can be obtained.

Moreover, as similar to the embodiment 1, the display panel 101 is produced together with the RP and others in which the electron ray emission device is incorporated, application of a high voltage and driving of a device are performed under the condition which is the same as that in the embodiment 1.

Here, no discharge was generated until the 9 kV driving in the vicinity of the spacer 1020. In addition, the light emission spot lines are formed at equal intervals in the two-dimensional manner, including the light emission spots produced by the electron emitted from the cold cathode device 1012 in the vicinity of the spacer 1020, which results in display of a clear color image having the good color reproducibility. This means that any distortion in the electric field which affects the electron orbit is not generated even though the spacer 1020 is provided.

Incidentally, the conductive film 206 is not restricted to a material used in this embodiment and a material which can be produced from a film type material and has a sufficiently low resistance value as compared with that of the high resistance film 11 can be selected. Further, the binder or the solvent is not restricted those described above. For example, the conductive film having the similar effect can be formed by using ZnO, $In_2O_3$ and Ag in place of $SnO_2$ in the above embodiment.

(Embodiment 3)

A spacer used in an embodiment 3 is produced as described below. Each reference numeral denotes each corresponding part in the embodiments 1 and 2.

A soda lime glass substrate (see FIG. 1) similar to that in the embodiment 1 is used as the spacer substrate 210, and a film type material 205 manufactured by the procedure similar to that in the embodiment 1 is used as a material of the conductive film 206.

The conductive film 206 is then formed at a desired position (equal to the embodiment 1) of the spacer substrate 201.

Its procedure is explained with reference to FIGS. 3A to 3D.

Figure 3A:
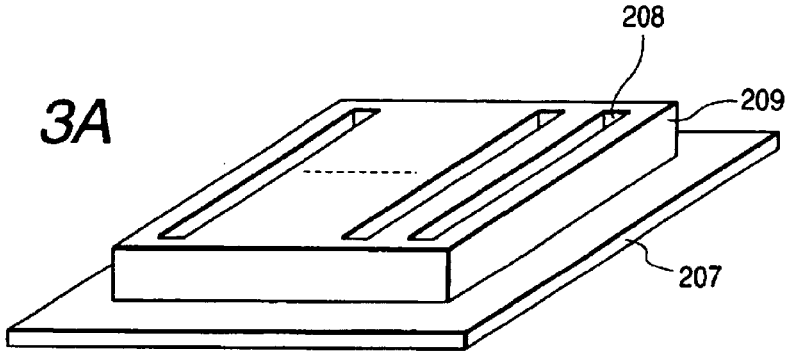
FIGS. 3A, 3B, 3C and 3D are views showing a method for providing the conductive film of the spacer according to an embodiment 3 of the present invention.
Figure 3B:
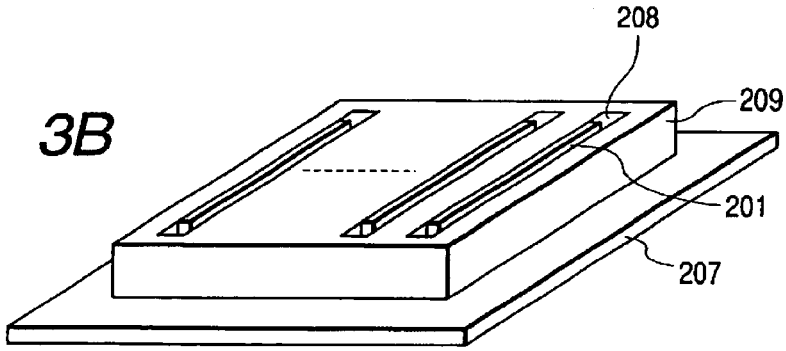
Figure 3C:
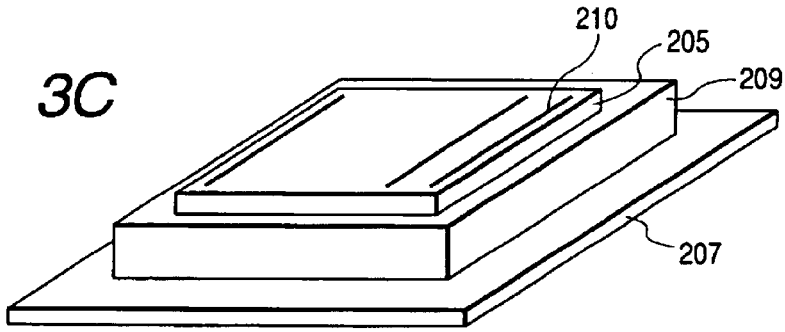
Figure 3D:
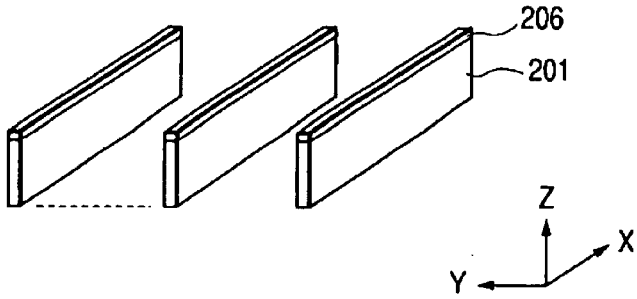

(1) A holding jig 209 having holes 208 whose size is substantially the same as that of the spacer is mounted on a horizontal plate 207 (polytetrafluoroethylene substrate in this example) (FIG. 3A);

(2) the spacer substrate 201 is set in each hole 208 (FIG. 3B);

(3) the film type material 205 is mounted thereon (FIG. 3C);

(4) a YAG laser beam is irradiated on a desired film forming position 210 (transfer);

(5) the holding jig and the residual film type material are removed (FIG. 3D); and (6) each film is finally baked at 450° C. for 2 hours.

The width and the thickness of the hole formed in the holding jig are such that the spacer substrate 201 can smoothly pass through the hole and the spacer substrate 201 can be substantially vertically held with respect to the film type material 205, and the height of the hole is so set as to be slightly lower than the height of the spacer substrate 201 in order to assuredly bring the film type material 205 into contact with the spacer substrate 201.

The YAG laser irradiation condition is that an output is 50 W; a spot diameter, 100 $\mu m\phi$; and a scanning speed, 100 m/sec. Although the laser irradiation time becomes long, the calcination process of (6) in FIG. 3D can be omitted by setting the scanning speed to 100 m/sec.

By the laser irradiation of (4), the film forming material is selectively transferred to the spacer at only an irradiated position, and the calcination process of (6) can remove the binder in the film forming material and form $SnO_2$ by the thermal decomposition reaction. With these operations, a spacer having the conductive film formed on one of the contact surfaces can be obtained.

When these film forming operations are again carried out with respect to the opposed surface, a spacer having the conductive films formed on the both contact surfaces can be formed.

In the above procedure, when the film type material 205 is transferred to the opposed contact surface before the calcination of (6) and the calcination is finally carried out, the films can be simultaneously formed on the both sides.

Figure 4:
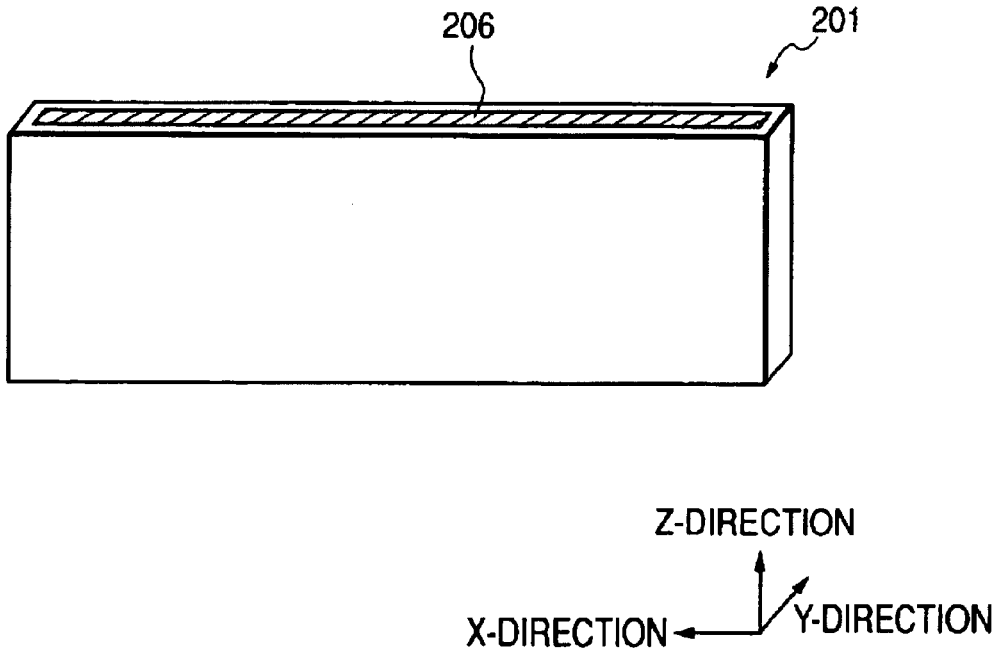
FIG. 4 is a view showing a characteristic of the conductive film of the spacer according to the embodiment 3 of the present invention.

The conductive film 206 formed in this embodiment can be made narrower than the spacer thickness as shown in FIG. 4. This is advantageous because a large process margin can be obtained with respect to the extrusion of the conductive film to the vacuum portion (which may lead to a reduction in a withstand high voltage).

The film type material 205 which can be a material of the conductive film is not restricted to that described above, and all the materials described in the embodiments 1 and 2 can be selected.

Additionally, the spacer substrate 201 is not limited to the soda lime glass, a material thereof can be appropriately selected from various kinds of glass or ceramics.

The high resistance film (antistatic film) 11 is then formed on the surface of the spacer substrate 201 by the method similar to that in the embodiment 1 to form the spacer 1020 in this embodiment.

Further, as similar to the embodiment 1, the display panel is produced together with the RP and others in which the electron ray emission device is incorporate, and application of a high voltage and driving of a device are effected under the condition which is the same as that in the embodiment 1.

Here, discharge is not generated until the 9 kV driving in the vicinity of the spacer 1020. Moreover, the light emission spot lines are formed at equal intervals in the two-dimensional manner, including the light emission spots produced by the electron emitted from the cold cathode device 1012 in the vicinity of the spacer 1020, which results in display of a clear color image having the good color reproducibility. This means that a distortion in the electric field that affects the electron orbit is not generated even though the spacer 1020 is provided.

Although the film type material at a predetermined position is heated by using the laser beam, a non-coherent beam may be converged in place of the laser beam by using the optical system. Further, a wire type heater may be used to cause the wire type heater to contact with or come close to the film type material so that only an area at which the wire type heater contacts with or comes close to the film type material is heated in order to form a film patterned in accordance with a shape of the wire type heater. A film having a desired shape can be formed by making the heater into a desired shape.

(Embodiment 4)

A spacer used in an embodiment 4 is produced as described below. Each reference numeral denotes a corresponding part in the embodiments 1 to 3.

A soda lime glass substrate (see FIG. 1) similar to that in the embodiment 1 is used as the spacer substrate 201, and a film type material 205 produced by the procedure similar to that in the embodiment 1 is used as a material of the conductive film 206.

The film type material 205 is subsequently used to form the conductive film 206 at a desired position of the spacer substrate 201. Its procedure is as described below (see FIGS. 5A to 5C).

Figure 5A:
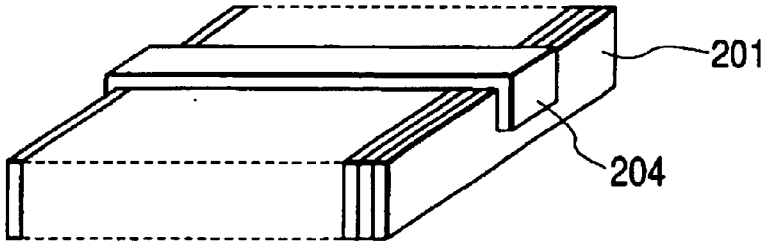
FIGS. 5A, 5B and 5C are views showing a method for providing the conductive film of the spacer according to an embodiment 4 of the present invention.
Figure 5B:
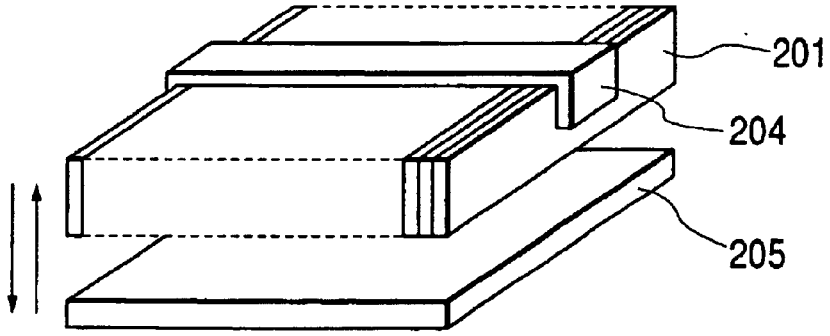
Figure 5C:
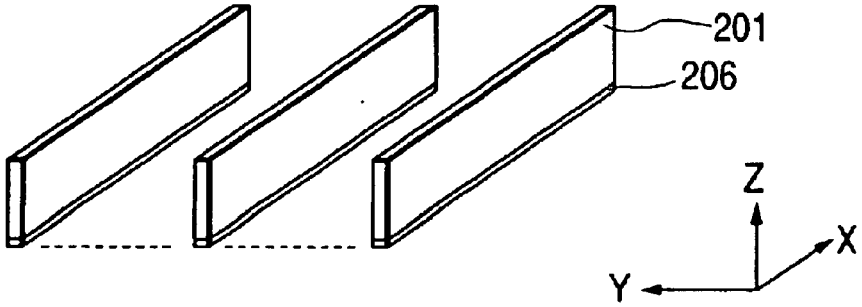

(1) A plurality of spacer substrates 201 are bundled in such a manner that film formation surfaces are aligned and they are fixed by an appropriate bundling jig 204 so as not be disassembled (FIG. 5A);

(2) they are heated together with the bundling jig in an oven at 300° C.;

(3) they are applied onto the film type material and separated from it after approximately one second (transfer) (FIG. 5B);

(4) they are baked in the oven at 450° C. for two hours; and (5) after the temperature is lowered to a room temperature, the bundling jig is removed and they are separated from each other one by one (FIG. 5C).

The film type material 205 is selectively transferred to a desired position of the spacer substrate 201 in (3); the binder in the film type material is removed by the calcination of (4); and $SnO_2$ is formed by the thermal decomposition reaction. The spacer substrate 201 having the conductive film 206 formed on one of the contact surfaces can be obtained by these operations.

When these film forming operations are again carried out with respect to the opposed surface, the spacer substrate 201 having the conductive films 206 formed on the both contact surfaces is formed.

Further, when the film type material 205 is transferred on the opposed contact surface before calcination of (5) in the above-described procedure and calcination is finally performed, the films can be simultaneously formed on the both surfaces.

The film type material 205 which can be a material of the conductive film 206 is not restricted to the material described above, and all the materials described in the embodiments 1 to 3 can be used.

Furthermore, the material used as the spacer substrate 201 is not restricted to the soda lime glass, and any material can be appropriately selected from various kinds of glass or ceramics.

The high resistance film (antistatic film) 11 is thereafter formed on the surface of the spacer substrate 201 by the method similar to that in the embodiment 1 so that the spacer 1020 according to this embodiment can be obtained.

As similar to the embodiment 1, the display panel 101 is produced together with the RP and others to which the electron ray emission device is incorporated, and application of a high voltage and driving of the device are carried out under the same condition as in the embodiment 1.

Here, discharge does not occur until the 9 kV driving in the vicinity of the spacer 1020. The light emission spot lines are formed at equal intervals in the two-dimensional manner, including the light emission spots generated by the electron emitted from the cold cathode device 1012 close to the spacer 1020, which results in display of a clear color image having the good color reproducibility. This means that the distortion in the electric field that affects the electron orbit is not generated even though the spacer 1020 is provided.

The manufacturing process of each conductive film 206 formed according to the respective embodiments is simple and facilitated, and the electrical contact of the obtained film is excellent. In addition, the discharge withstand voltage property is good, and hence the quality in display obtained by the electron ray can be improved. Moreover, it is also particularly effective for the manufacturing process requiring the mass productivity and the low cost and the electron source using this process.

(Embodiment 5)

Although the film type material 205 is removed from the substrate used for forming the film type material and thereafter attached to the spacer substrate 201 in the foregoing embodiments, the film type material 206 is processed together with the base material and attached to the spacer substrate together with the base material in this embodiment. It is to be noted that the substrate used for forming the film type material is used as the base material.

A spacer used in the embodiment 5 is produced as described below. Each reference numeral denotes each corresponding part in the embodiments 1 to 4.

A glass substrate is used as the spacer substrate 201 in this embodiment. Its shape is the same as that of the soda lime glass substrate in the embodiment 1. The conductive film 206 is then formed at a desired position (as similar to the embodiment 1) of the spacer substrate 201.

In regard to the procedure for forming the conductive film 206, this embodiment is different from the above-described embodiments in the following two points.

(1) A transparent glass substrate having an appropriate flat surface is used for forming the film type material.

In this embodiment, the transparence means that an effective amount of light which is enough for dissolving and transferring the contained metal material on the rear surface can be selected with respect to light stimulus heating means (for example, a laser beam) used in the subsequent step, and there is not need to provide a specular surface or a penetrating spectrum does not have to has a flat characteristic with respect to the visible light.

(2) The film containing a metal to be transferred is attached to the spacer substrate without being removed from the glass substrate. When the laser beam is irradiated on the film fixed to the glass substrate from the opposed side of the film forming surface, the film can be formed at a desired position of the spacer substrate 201.

As forming means other than the above, for example, the conductive film material and the like is similar to that in the embodiment 1.

The structure in which the film type material overlaps on the base material to be used as in this method is preferable for forming the conductive film having an appropriate thickness of several microns or below, or approximately 0.1 micron in particular as compared with the case where the film type material is used as an elemental substance and it is hardly influenced by damages such as a crack which is often generated when the film type material is processed as an elemental substance.

As described above, according to each embodiment, the spacer to which the conductive film is added can be easily and inexpensively produced without requiring a vacuum decompressor, and it is possible to inexpensively provide the image display apparatus which can suppress displacement of the light emission portion caused due to electrification and has the high display quality.

In the present invention of this application, the limit in the member used in the electron source apparatus such as a spacer can be eased in the coating process.

What is claimed is:

1. A method for manufacturing a spacer for use in an electron source apparatus comprising an electron source having an electron emission device, an opposing member opposed to the electron source and a spacer provided between the electron source and the opposing member, said method comprising:

a coating step for providing a film to a spacer substrate constituting the spacer, said coating step including a step for bringing a preformed film type material into contact with the spacer substrate.

2. A method for manufacturing a spacer according to claim 1, wherein said step for bringing includes bringing one film type material into contact with a plurality of spacer substrates.

3. A method for manufacturing a spacer according to claim 1, wherein said step for bringing is carried out by bundling a plurality of spacers.

4. A method for manufacturing a spacer according to claim 1, wherein said coating step is a step for providing the film on a contact surface of the spacer that is adjacent to the electron source or a contact surface of the spacer that is adjacent to the opposing member or both contact surfaces adjacent to the electron source and opposing member, respectively.

5. A method for manufacturing a spacer according to claim 1, wherein, after the film type material is brought into contact with the spacer substrate, the film is formed by a material contained in the film type material.

6. A method for manufacturing a spacer according to claim 5, wherein, in a step for forming the film by the material contained in the film type material, the film type material is heated.

7. A method for manufacturing a spacer according to claim 6, wherein the film type material is heated by heat added from outside after the film type material is brought into contact with the spacer substrate.

8. A method for manufacturing a spacer according to claim 6, wherein the film type material is heated by heat that the spacer substrate has.

9. A method for manufacturing a spacer according to claim 6, wherein the film type material is heated by heat given by light irradiation.

10. A method for manufacturing a spacer according to claim 9, wherein the light irradiation of a laser beam.

11. A method for manufacturing a spacer according to claims 1 and 5-10, wherein the film has conductivity.

12. A method for manufacturing a spacer for use in an electron source apparatus comprising an electron source having an electron ray emission device, an opposing member opposed to the electron source and the spacer provided between the electron source and the opposing member, said method comprising:

a coating step for providing a film on a spacer substrate constituting the spacer, said coating step including a supplying step for supplying a material of the film to a wide region that includes, and is broader than, a film covering region of the spacer substrate; and a position selective film forming step for forming the film only at the film covering region, with only part of the material supplied on the spacer substrate.

13. A method for manufacturing a spacer according to claim 12, wherein the film is obtained by heating the material supplied in said supplying step and said position selective film forming step is a step for selectively heating only the part of the material supplied in said supplying step.

14. A method for manufacturing a spacer according to claim 13, wherein the selectively heating is performed by light irradiation.

15. A method for manufacturing a spacer according to claim 13, wherein the selectively heating is carried out by irradiation of a laser beam.

16. A method for manufacturing a spacer according to claim 13, wherein the selectively heating is performed by using a heater provided with a heat source portion having a shape corresponding to a selective heating position.

17. A method for manufacturing a spacer for use in an electron source apparatus comprising an electron source apparatus comprising an electron source having an electron ray emission device, an opposing member opposed to the electron source and the spacer provided between the electron source and the opposing member, said method comprising:

a coating step for providing a film on a spacer substrate constituting the spacer, said coating step including a supplying step for supplying a material of the film to a wide region that includes, and is broader than, a film covering region of the spacer substrate; and a film forming step for forming the film only at the film covering region, with only part of an area of the material supplied on the spacer substrate.

18. A method for manufacturing a spacer according to claim 17, wherein the film is obtained by heating the material, and the film forming step includes a step of selectively heating only the part of the material supplied on the area of the spacer substrate.

19. A method for manufacturing a spacer according to claim 18, wherein the selectively heating step is carried out by irradiation of a laser beam.

* * * * *

UNITED STATES PATENT AND TRADEMARK OFFICE

CERTIFICATE OF CORRECTION

PATENT NO. : 6,884,138 B1
APPLICATION NO. : 09/511349
DATED : April 26, 2005
INVENTOR(S) : Yoichi Ando et al.

It is certified that error appears in the above-identified patent and that said Letters Patent is hereby corrected as shown below:

Title page,
Item [56], References Cited, OTHER PUBLICATIONS, "H. Araki" reference, "th Vacuum," should read -- the Vacuum, -- and "1983, pp. 22-29" should read -- 1983, Vol. 26, No. 1, pp. 22-29 --.

Column 1,
Line 35, "and et al.," should read -- et al., --;
Line 38, "and et al." should read -- et al. --;
Line 40, "device," should read -- devices, --; and
Line 41, "and et" should read -- et --.

Column 2,
Line 8, "for example," should be deleted;
Line 11, "molybden um" should read -- molybdenum --;
Line 12, "the other" should read -- others --;
Line 15, "and et al." should read -- et al. --;
Line 24, "in substantially" should read -- substantially --; and
Line 27, "for example," should be deleted.

Column 3,
Line 6, "expected" should read -- preferred --;
Line 19, "and et al." should read -- et al. --; and
Line 22, "(1991)]" should read -- (1991)]. --.

Column 5,
Lines 47 and 52, "as that" should read -- that --; and
Line 51, "have a" should read -- have --.

Column 6,
Line 12, "provided, as a" should read -- provided. As a --; and
Line 27, "case" should read -- the case --.

Column 7,
Line 5, "uniformizing" should read -- uniformize --; and
Line 10, "for uniformizing" should read -- of uniformizing --.

Column 8,
Line 57, "ion" should read -- an ion --.

UNITED STATES PATENT AND TRADEMARK OFFICE

CERTIFICATE OF CORRECTION

PATENT NO. : 6,884,138 B1
APPLICATION NO. : 09/511349
DATED : April 26, 2005
INVENTOR(S) : Yoichi Ando et al.

It is certified that error appears in the above-identified patent and that said Letters Patent is hereby corrected as shown below:

Column 11,
Line 45, “At last,” should read -- And last, --; and
Line 57, “denote” should read -- denotes --.

Column 13,
Line 3, “desirable” should read -- desirably --;
Line 7, “[Ω/□]” should read -- [Ω/□]. --; and
Line 16, “temperature up.” should read -- temperature increase. -- and
“keeps” should read -- continues --.

Column 14,
Line 42, “god” should be deleted; and
Line 43, “binder” should read -- binders -- and “those” should read -- to those --.

Column 15,
Line 1, “a light” should read -- light --.

Column 16,
Line 11, “restricted” should read -- restricted to --.

Column 17,
Line 19, “incorporate,” should read -- incorporated, --; and
Line 57, “not be” should read -- not to be --.

Column 19,
Line 8, “have to has” should read -- have to have --.

UNITED STATES PATENT AND TRADEMARK OFFICE

CERTIFICATE OF CORRECTION

PATENT NO. : 6,884,138 B1
APPLICATION NO. : 09/511349
DATED : April 26, 2005
INVENTOR(S) : Yoichi Ando et al.

It is certified that error appears in the above-identified patent and that said Letters Patent is hereby corrected as shown below:

Column 20,
Line 12, "irradiation" should read -- irradiation is irradiation --;
Line 14, "claims 1 and 5-10," should read -- claims 1, 5-8, or 10, --;
Lines 35, 38 and 42, "selectively" should read -- step for selectively --;
Line 45, "comprising an electron source" should be deleted; and
Line 46, "apparatus" should be deleted.

Signed and Sealed this

Eleventh Day of July, 2006

JON W. DUDAS
*Director of the United States Patent and Trademark Office*